US006406269B1

(12) United States Patent
Dingle et al.

(10) Patent No.: US 6,406,269 B1
(45) Date of Patent: Jun. 18, 2002

(54) FUEL PUMP

(75) Inventors: Philip John Gregory Dingle, Rochester, MI (US); George Nicholas Felton, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/634,517

(22) Filed: Aug. 8, 2000

(30) Foreign Application Priority Data

Aug. 10, 1999 (GB) ..... 9918871

(51) Int. Cl.[7] ..... F04B 49/00; F15B 15/24; F02M 37/04

(52) U.S. Cl. ..... 417/218; 417/274; 417/470; 92/13; 92/60.5; 123/502; 123/504

(58) Field of Search ..... 417/218, 470, 417/274, 499; 123/500–504; 92/13, 60.5, 129

(56) References Cited

U.S. PATENT DOCUMENTS 2,863,438 A * 12/1958 Challis ..... 123/139
4,494,514 A * 1/1985 Augustin ..... 123/504
4,861,243 A * 8/1989 Wade ..... 417/490
5,193,510 A * 3/1993 Straubel ..... 123/502
5,415,533 A * 5/1995 Egger et al. ..... 123/90.5

* cited by examiner

*Primary Examiner*—Charles G. Freay
(74) *Attorney, Agent, or Firm*—Thomas N. Twomey

(57) ABSTRACT

A fuel pump comprises a pumping plunger reciprocable within a plunger bore under the action of a cam drive arrangement. The cam drive arrangement comprises first and second surfaces defining therebetween a chamber, the volume of which can be controlled to control the spacing of the first and second surfaces so as to permit control of the axial length of the cam drive arrangement. The first surface may be defined by a tappet member which acts to transmit a force from the cam drive arrangement to the pumping plunger, the second surface being defined by a piston member which is slidable within a tappet bore formed in the tappet member. The invention also relates to an arrangement for use in a fuel pump comprising a pumping plunger which is reciprocable within a plunger bore under the action of a drive arrangement and a tappet member which is slidable within a further bore provided in a housing for transmitting a force from the drive arrangement to the pumping plunger. The arrangement comprises a yoke secured to the housing, the yoke having at least one projection extending into the bore provided in the housing, the or each projection cooperating with the tappet member so as to substantially prevent angular movement of the tappet member within the further bore.

22 Claims, 10 Drawing Sheets

FUEL PUMP

TECHNICAL FIELD

This invention relates to a fuel pump for use in supplying fuel under high pressure for injection into a combustion space of an associated compression ignition internal combustion engine. The invention is particularly applicable to unit pump/injectors or to unit pumps, each being intended to deliver fuel to a single associated fuel injector. It will be appreciated, however, that the invention is also applicable to other types of fuel pump, for example in-line pumps.

BACKGROUND OF THE INVENTION

The pump of a unit pump/injector typically comprises a pumping plunger reciprocable within a bore under the action of a cam drive arrangement. Motion of the plunger, in use, is dependent upon the cam profile and the speed of operation of the cam drive arrangement. It is desirable to be able to modify the operation of the pump, for example to permit the timing of the delivery of fuel to be controlled, thereby permitting a reduction in the levels of white smoke, particulate emissions and noise produced when the engine is cold, and reducing the risk of miss-fires.

SUMMARY OF THE INVENTION

According to the present invention there is provided a fuel pump comprising a pumping plunger reciprocable within a plunger bore under the action of a cam drive arrangement, the cam drive arrangement comprising first and second surfaces defining therebetween a chamber, the volume of which can be controlled to control the spacing of the first and second surfaces, thereby permitting control of the axial length of the cam drive arrangement.

Where the pump is of the type in which a filling port is provided, the filling port being obscured, in use, by the pumping plunger, adjustment of the axial length of the drive arrangement permits the timing at which the filling port is closed by the pumping plunger, and hence the timing of commencement of pressurisation of fuel by the pump, to be controlled. By controlling the timing of commencement of pressurisation of fuel, depending upon the nature of the fuel injector with which the pump is to be used, the timing of commencement of fuel injection can be controlled. As a result, an arrangement is possible in which the timing of fuel delivery can be advanced, for example when the associated engine is cold.

The first surface is conveniently defined by a tappet member which acts to transmit a force from the cam drive arrangement to the pumping plunger.

The second surface may be defined by a piston member slidable within a tappet bore formed in the tappet member.

Preferably, the fuel pump comprises a spring arrangement arranged to apply a biasing force to the piston member which tends to minimise the volume of the chamber.

Conveniently, the plunger bore defines a pumping chamber for fuel, reciprocal movement of the pumping plunger within the plunger bore causing fuel pressurisation within the pumping chamber, in use. The fuel pump may further comprise a further spring arrangement which is arranged to urge the tappet member in a direction to withdraw the pumping plunger from the plunger bore, thereby tending to maximise the volume of the pumping chamber.

The cam drive arrangement may include a drive member which carries the piston member, a force from the piston member being transmitted to the pumping plunger through the drive member. The drive member and the piston member may be integrally formed.

In an alternative embodiment, the piston member may be secured directly to the pumping plunger.

The tappet member may be shaped to define, at least in part, a relief passage which communicates with the chamber upon movement of the piston member beyond a predetermined position.

Alternatively, the tappet member may be provided with a circlip which is engageable with the piston member upon movement of the piston member beyond a predetermined amount.

Preferably, the tappet member is slidable within a further bore provided in a housing, the fuel pump preferably comprising means for substantially preventing angular movement of the tappet member within the further bore.

For example, one of the tappet member and the housing may be provided with a member which extends into a recess provided in the other of the tappet member and the housing so as to substantially prevent angular movement of the tappet member within the further bore.

The member may take the form of a peg carried by the tappet member, the peg extending through an opening provided in a drive member forming part of the drive arrangement so as to substantially prevent angular movement of the tappet member within the further bore.

Alternatively, the pump may comprise a yoke secured to the housing, the yoke having at least one projection extending into the further bore provided in the housing, the or each projection cooperating with the tappet member so as to substantially prevent angular movement of the tappet member within the further bore.

The piston member may include a region of part-spherical form which is cooperable with the tappet bore to permit axial misalignment between the piston member and the tappet member.

Preferably, the chamber is arranged to receive fluid through a supply passage, fluid pressure within the chamber applying a force to the first and second surfaces which serves to increase the volume of the chamber.

The fuel pump may further comprise a temperature sensitive valve arrangement, the pressure of fluid supplied to the chamber being controlled in response to an output from the temperature sensitive valve arrangement.

According to a second aspect of the present invention, there is provided an arrangement for use in a fuel pump comprising a pumping plunger which is reciprocable within a plunger bore under the action of a drive arrangement and a tappet member which is slidable within a further bore provided in a housing for transmitting a force from the drive arrangement to the pumping plunger, the arrangement comprising a yoke secured to the housing, the yoke having at least one projection extending into the bore provided in the housing, the or each projection cooperating with the tappet member so as to substantially prevent angular movement of the tappet member within the further bore.

It will be appreciated that this aspect of the invention is not limited to use in a fuel pump driven by means of a cam drive arrangement, nor is it limited to use in a fuel pump in which first and second surfaces of the drive arrangement define a chamber, the volume of which can be controlled to control the spacing of the first and second surfaces.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
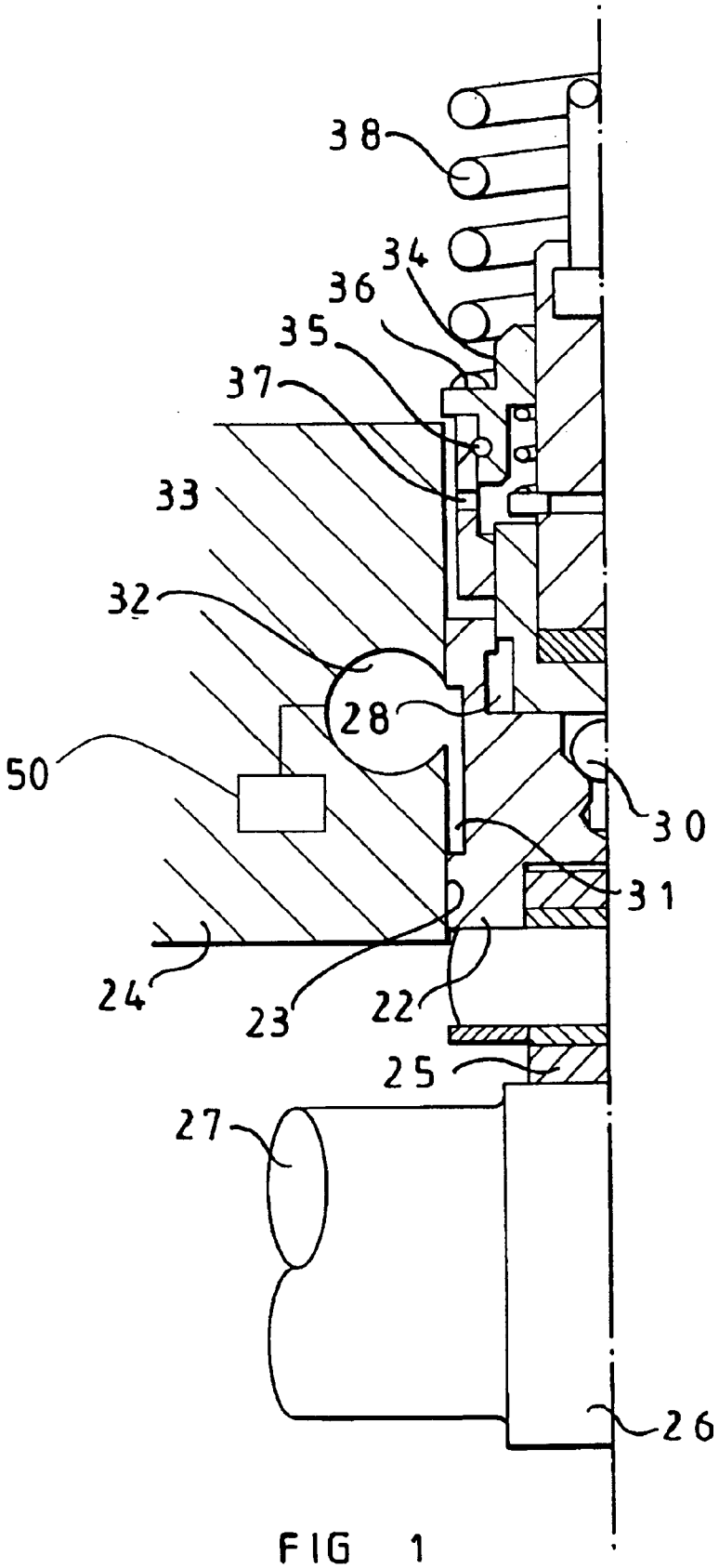
FIGS. 1 and 2 are sectional views illustrating part of a fuel pump in accordance with an embodiment of the invention.
Figure 2:
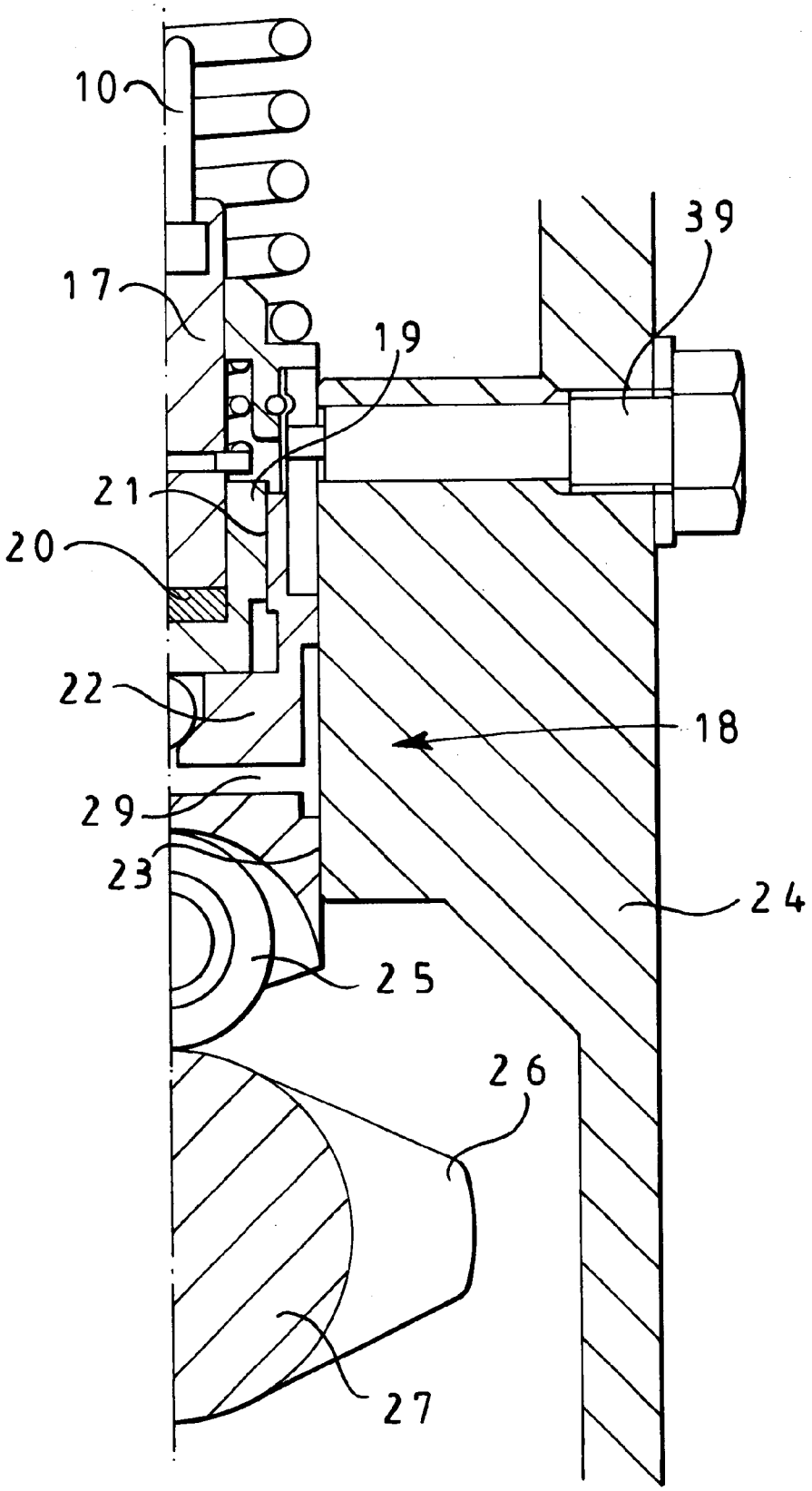
Figure 3:
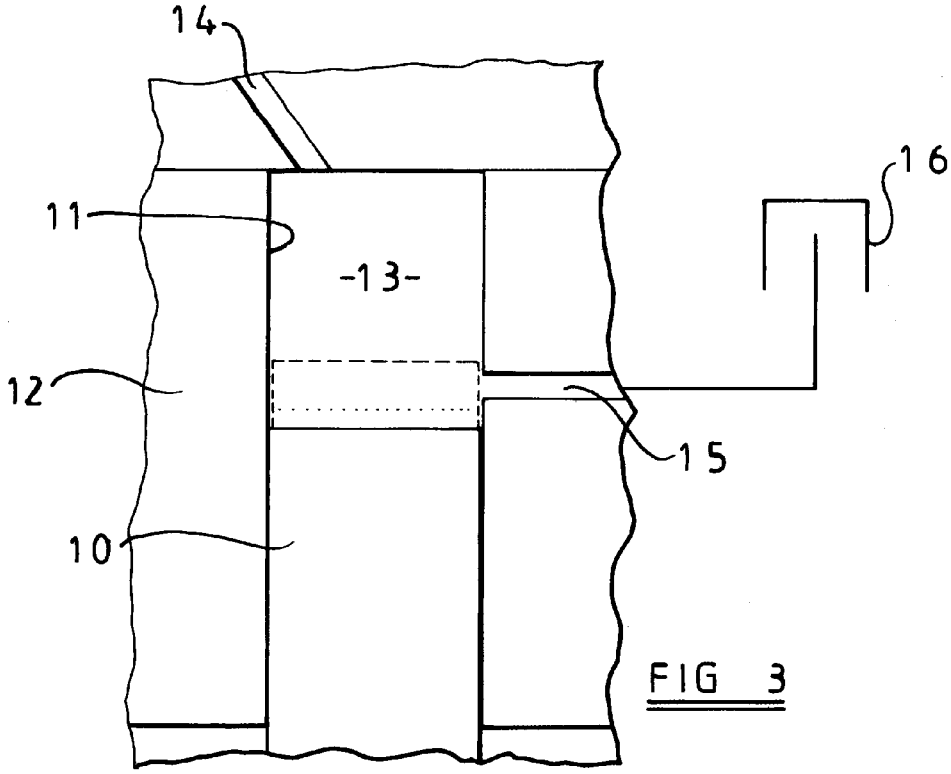
FIG. 3 is a diagrammatic view of another part of the fuel pump of FIGS. 1 and 2.

The fuel pump illustrated in FIGS. 1, 2 and 3 is intended to form part of a unit pump/injector and comprises a pumping plunger 10 which is reciprocable within a bore 11 formed in a pump body 12. The plunger 10 and bore 11 together define a pumping chamber 13 which communicates with an outlet passage 14 and, depending upon the axial position occupied by the pumping plunger 10, with a feed or filling port 15. The feed port 15 communicates with a suitable low pressure fuel reservoir 16.

At its end remote from the end located within the bore 11, the plunger 10 is secured to a drive member 17 forming part of a drive arrangement 18. The drive member 17 carries a piston member 19, a shim 20 being located between the piston member 19 and the drive member 17 such that the axial position of the piston member 19 relative to the drive member 17 can be set during the assembly process of the drive arrangement 18.

The piston member is slidable within a bore 21 formed in a tappet 22, the tappet 22 being slidable within a bore 23 formed in a housing member 24. The tappet 22 carries a roller 25, the outer periphery of which is engageable with a cam 26 mounted upon a drive shaft 27.

The bore 21 provided in the tappet 22 defines, with the piston member 19, a chamber 28 of variable volume. The tappet 22 is provided with drillings defining a flow passage 29 whereby engine lubricating oil or another fluid can be supplied to the chamber 28. A ball valve arrangement 30 is provided to restrict the flow of fluid from the chamber 28 along the passage 29, but to permit fuel flow towards the chamber 28 at a substantially unrestricted rate. The ball valve arrangement 30 is conveniently spring-biased closed.

The flow passage 29 communicates with an annular recess 31 defined between the tappet 22 and the wall of the bore 23, the recess 31 communicating, in turn, with a supply passage 32 which is arranged such that, in use, lubricating oil or another fluid at a desired pressure can be applied thereto. The manner in which the oil or other fluid pressure is controlled does not form part of the invention and so will be not described in great detail.

The tappet 22 is shaped to define a relief passage 33 which communicates with the chamber 28 upon movement of the piston member 19 beyond a predetermined position. The relief passage 33 communicates with the interior of the cam housing and is thus under relatively low oil pressure.

As illustrated in FIGS. 1 and 2, the open end of the bore 21 provided in the tappet 22 is closed by means of a cap 34 which is retained in position using a spring clip 35 or any other suitable technique. A spring 36 is engaged between the cap 34 and a spring abutment member 37 carried by the drive member 17 to apply a biasing force to the piston member 19 urging the piston member 19 into engagement with the blind end of the bore 21 formed in the tappet 22. The spring 36 therefore urges the piston member 19 towards a position in which the chamber 28 is of minimum volume. The cap 34 further engages a return spring 38 which is positioned to urge the tappet 22 in a direction to withdraw the plunger 10 from the bore 11, urging the plunger 10 towards a position in which the pumping chamber 13 is of maximum volume.

The housing 24 is provided with a screw-threaded pin 39, an end of which projects into the bore 23 and rides within a slot formed in the tappet 22 to hold the tappet 22 against angular movement within the bore 23, but to allow axial movement of the tappet 22 in a substantially unrestricted manner. It will be appreciated that by holding the tappet 22 against angular movement, the roller 25 is held such that its axis of rotation lies substantially parallel to the axis of rotation of the drive shaft 27.

In use, with the supply passage 32 being supplied with engine lubricating oil at a relatively low pressure, the chamber 28 is at relatively low pressure and the spring 36 urges the piston member 19 towards the position shown in which the end surface thereof engages the surface defined by the blind end of the bore 21. The roller 25 is in engagement with the base of the cam 26, the roller 25 being urged into engagement with the cam 26 by the return spring 38. It will be appreciated that the tappet 22 occupies its outermost position, and likewise the plunger 10 occupies its outermost position. As illustrated in FIG. 3, in this position the pumping chamber 13 communicates with the feed port 15, the pumping chamber 13 being charged with fuel to a relatively low pressure.

Rotation of the drive shaft 27 causes the roller 25 to move into engagement with the cam lobe, causing the tappet 22 to move upwardly in the orientation illustrated in FIGS. 1 and 2, the movement of the tappet 22 being transmitted directly to the piston member 19, and through the shim 20 to the drive member 17 from where it is transmitted to the pumping plunger 10 urging the pumping plunger 10 in an upwards direction in the orientation illustrated in FIG. 3. The initial movement of the pumping plunger 10 displaces fuel from the pumping chamber 13 through the feed port 15 to the reservoir 16. Displacement of fuel from the pumping chamber 13 in this manner continues until the pumping plunger 10 has moved by a sufficient distance to close the feed port 15. Once this position has been reached, as denoted by the dashed line in FIG. 3, further movement of the pumping plunger 10 under the action of the drive arrangement 18 pressurizes the fuel within the pumping chamber 13 and supplies fuel under high pressure to the outlet passage 14 from where it is supplied to an injection nozzle forming part of the pump injector. It will appreciated that when the pump is operating in this manner, the timing of commencement of fuel pressurization is dependent upon the shape of the cam lobe, commencement of pressurization occurring once the plunger 10 has moved by a sufficient distance to cover the feed port 15. Fuel delivery at high pressure continues until either a spill valve connected to the outlet passage 14 is opened or the plunger 10 reaches an inner position, or more preferably by a spill passage or groove, conveniently of angled or helical form, provided in the plunger aligns with the feed port provided in the housing to allow fuel to escape from the pumping chamber to a low pressure reservoir. Once the plunger reaches an inner position, movement of the plunger 10 to the position illustrated occurs under the action of the return spring 38.

Where it is determined that the timing of commencement of fuel delivery by the pump should be advanced, lubricating oil under relatively high pressure is applied to the supply passage 32. Such an application of lubricating oil under pressure permits oil to flow through the passage 29 past the non-return valve 30 to the chamber 28. The oil under pressure acts upon the surfaces of the piston member 19 and the blind end of the bore 21 formed in the tappet 22 urging these surfaces away from one another, movement of the piston member 19 relative to the tappet 22 continuing until a position is reached in which the chamber 28 communicates with the relief passage 33. The movement of the piston member 19 away from the blind end of the bore 21 formed in the tappet 22 occurs against the action of the spring 36. The movement of the piston member 19 is intended to occur when the tappet 22 occupies substantially the position illustrated in FIGS. 1 and 2 and the movement of the piston member 19 is transmitted to the plunger 10, thereby moving the plunger 10 from its outermost position by a small distance, for example to the position illustrated by a dotted line in FIG. 3.

Once the piston member 19 has been moved relative to the tappet 22, rotation of the drive shaft 27 causes movement of the tappet 22 as described hereinbefore. The motion of the tappet is transmitted through the lubricating oil located within the chamber 28 to the piston member 19 and from the piston member 19 through the shim 20 and drive member 17 to the plunger 10. It will be appreciated that the oil within the chamber 28 will be pressurized and the piston member 19 will move to a position in which the relief passage 33 is closed and the non-return valve 30 will occupy a closed position preventing oil from escaping through the passage 29 to the supply passage 32.

The inward movement of the tappet 22 causes inward movement of the plunger 10 as described hereinbefore. However, as the axial length of the drive arrangement 18 is increased by moving the piston member 19 relative to the tappet 22 as described hereinbefore, the point at which the feed port 15 is closed by the pumping plunger 10 will occur at an earlier instant than would be the case if the drive arrangement 18 were of shorter axial length. As a result of the timing at which the feed port 15 is closed by the plunger 10 being advanced, the timing of commencement of fuel pressurization is advanced, and this can be used to advance the timing at which fuel is delivered by an associated fuel injector.

When it is desired to return the pump to its original operating setting, the supply passage 32 is no longer supplied with lubricating oil at high pressure, but rather is connected to a low pressure source of lubricating oil. The piston member 19 will return to the position illustrated, oil from the chamber 28 escaping either past the non-return valve 30 or leaking between the piston member 19 and the tappet 22. FIGS. 4 to 10 illustrate modifications to the arrangement described hereinbefore. Only the differences will be described, and it will be appreciated that, for the most part, the manner in which the arrangements operate will be as described hereinbefore.

Figure 4:
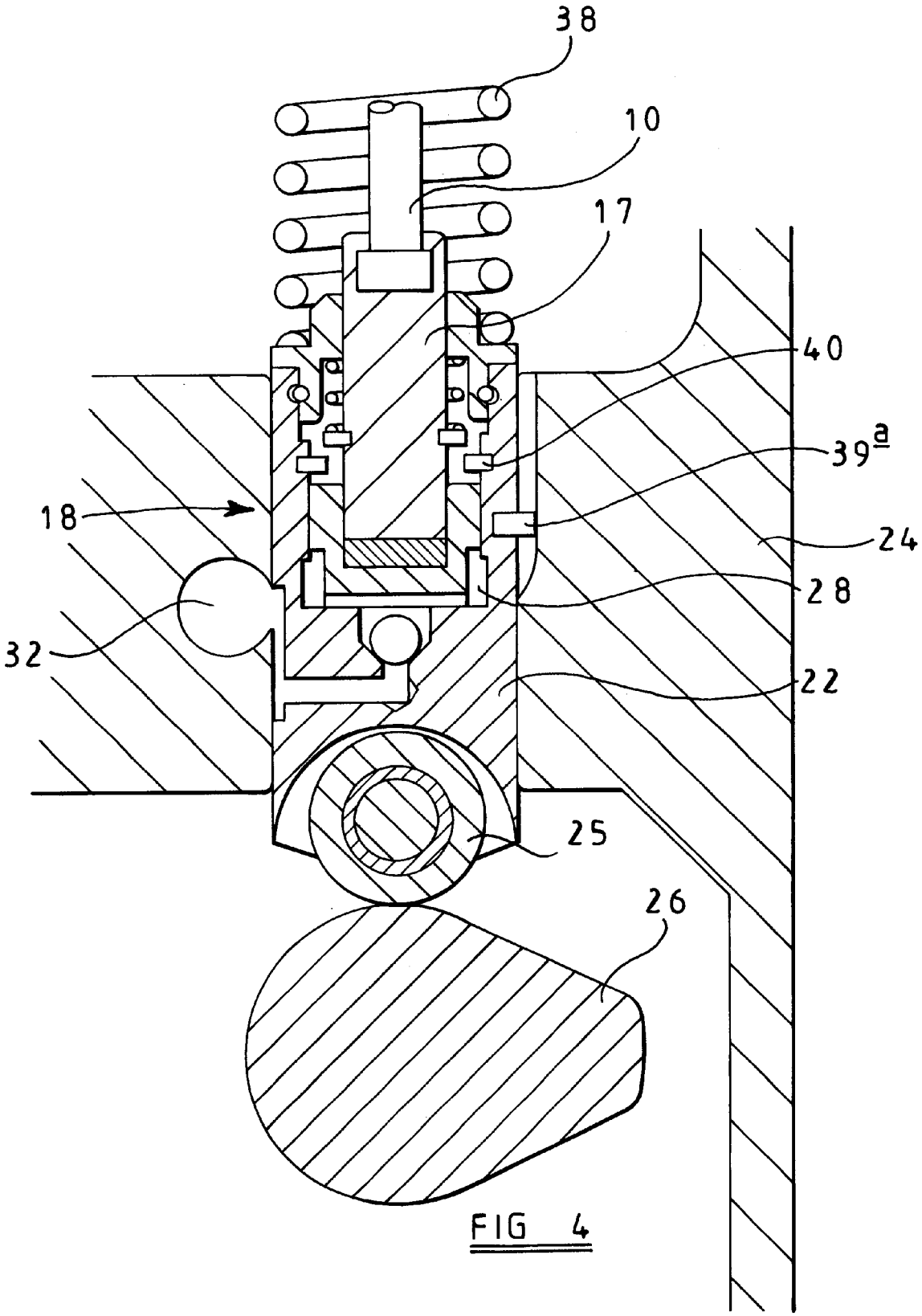
FIGS. 4 to 8 are views similar to FIG. 2 illustrating alternative embodiments.

FIG. 4 illustrates a modification to the arrangement illustrated in FIGS. 1 to 3. In the arrangement of FIG. 4, the distance through which the piston member 19 can move relative to the tappet 22 is not controlled by controlling the point at which the chamber 28 moves into communication with a relief passage, but rather by providing the tappet 22 with a circlip 40 which is engageable with the piston member 19 upon movement of the piston member 19 by a predetermined distance. A further distinction between the arrangement of FIG. 4 and that of FIGS. 1, 2 and 3 is that the screw-threaded pin 39 is replaced by a peg 39*a* carried by the tappet 22 and slidable within a slot formed in the bore 23. Operation of the embodiment of FIG. 4 is substantially identical to that of FIGS. 1, 2 and 3 with the exception that distance through which the piston member 19 can move is governed by the piston member 19 engaging the circlip 40 rather than by the chamber 28 moving into communication with a relief passage. The operation of the arrangement will, therefore, not be described in further detail.

Figure 5:
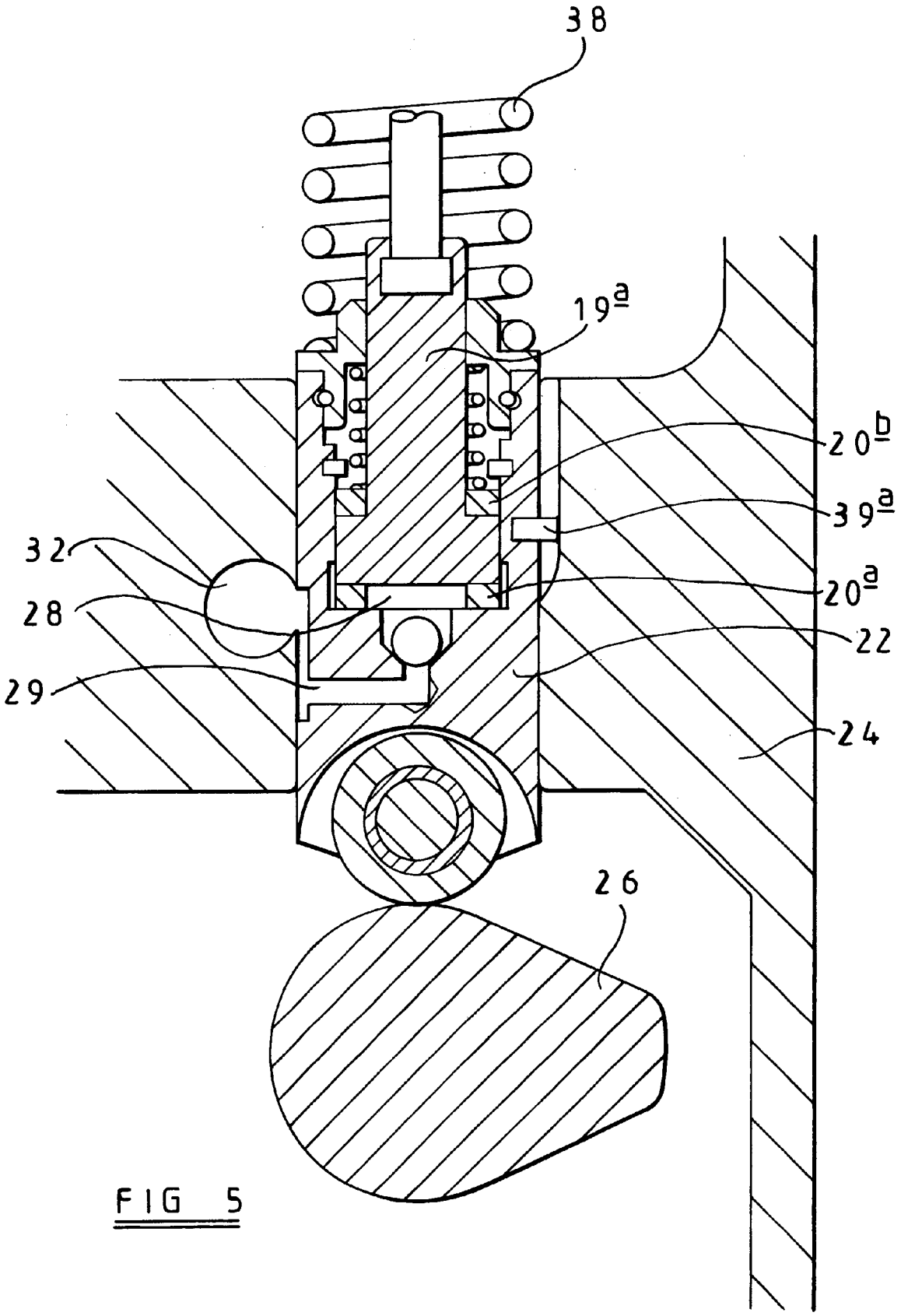

FIG. 5 illustrates an arrangement which is similar to that of FIG. 4 but in which the piston member 19 and drive member 17 are formed integrally with one another, and denoted by reference numeral 19*a*. As it is no longer possible to introduce a shim 20 between the piston member 19 and drive member 17, a shim 20*a* is provided to set the normal outermost position for the pumping plunger 10 and a shim 20*b* is provided to set the position occupied by the pumping plunger 10 when the pump is operating under circumstances in which the timing of fuel delivery by the pump is advanced.

Figure 6:
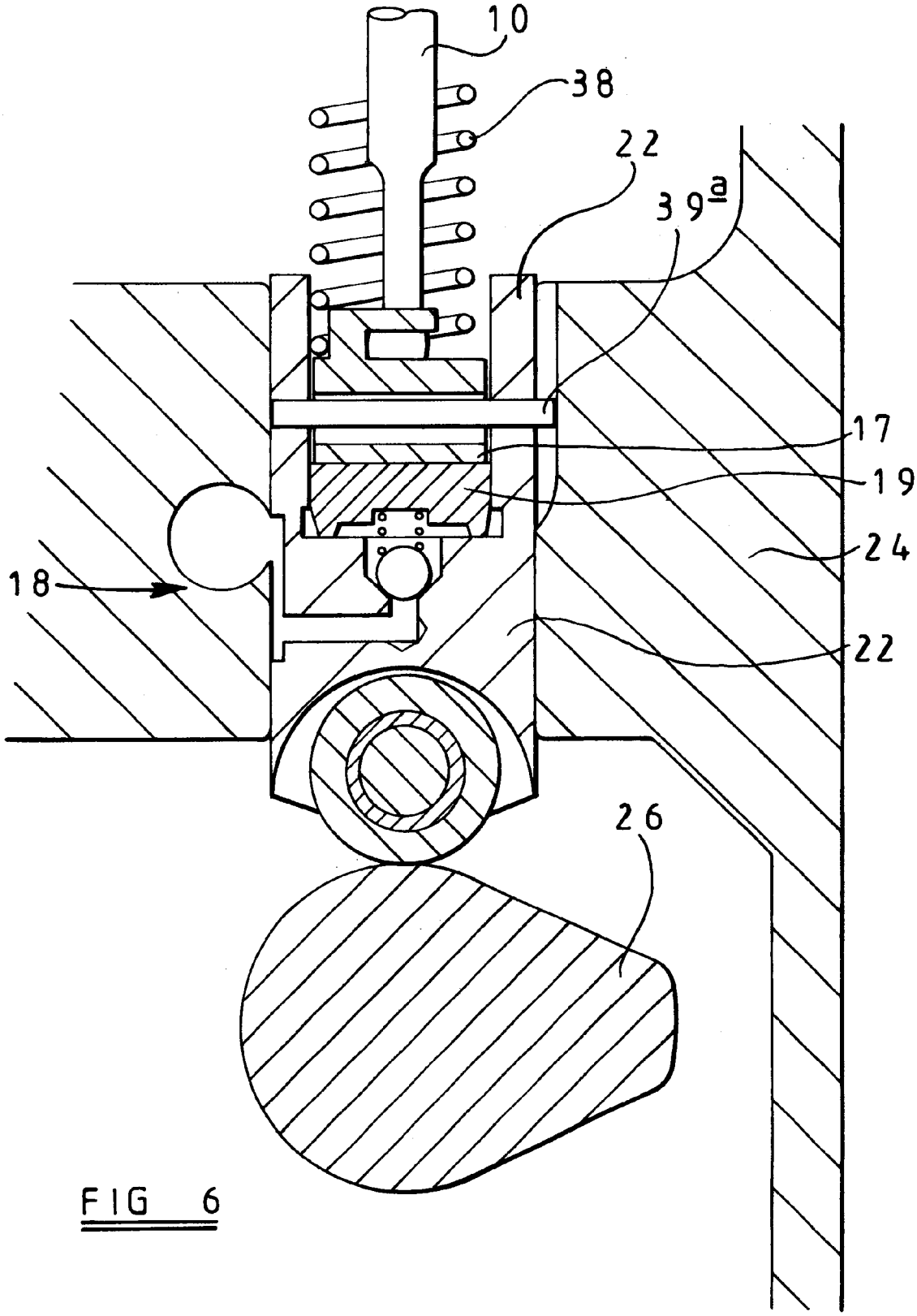
Figure 7:
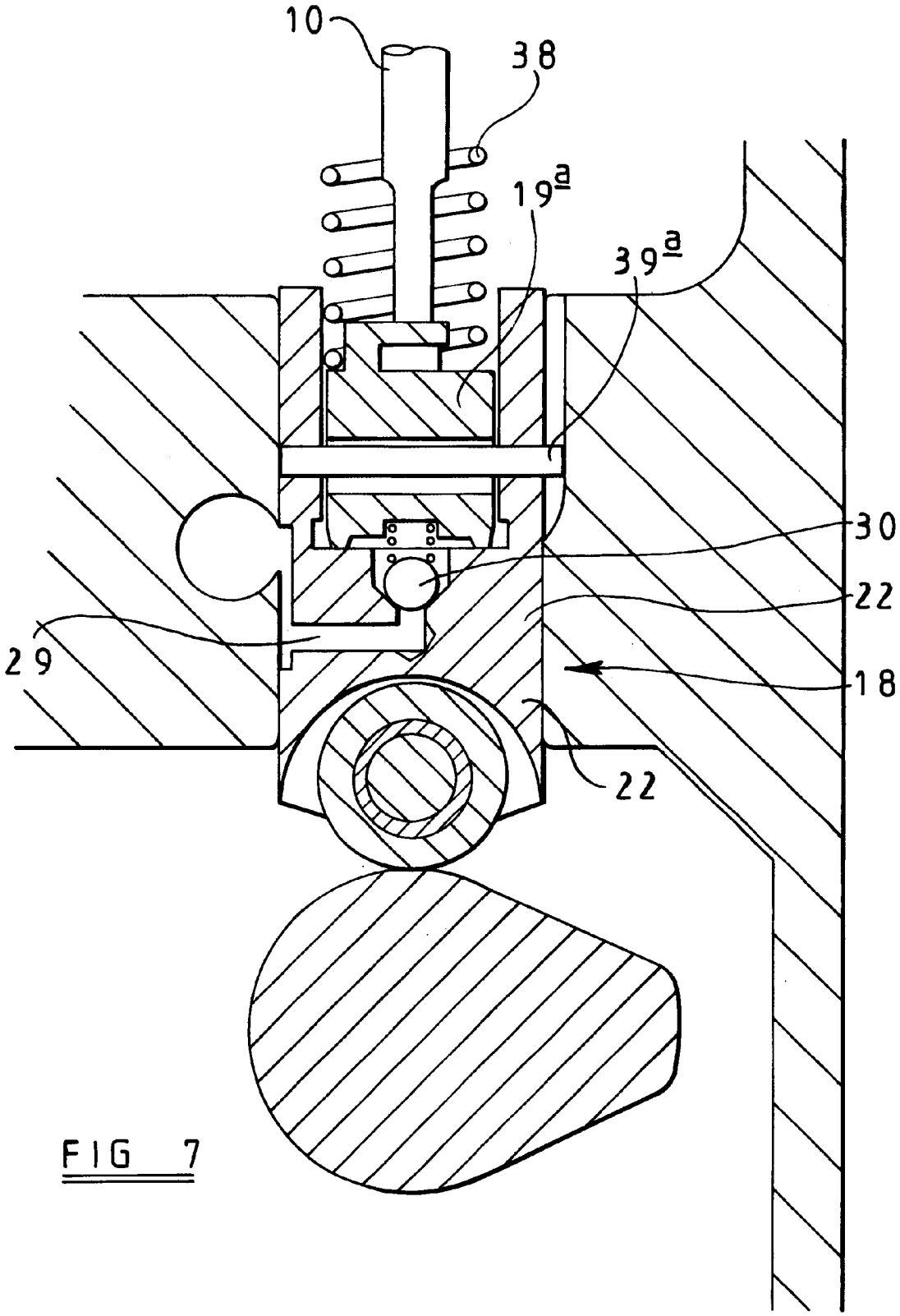

In the arrangement of FIG. 6, the peg 39*a* is of increased length and extends across the diameter of the tappet 22, extending through an opening formed in the drive member 17. The dimensions of the opening formed in the drive member 17 are chosen to limit the distance through which the piston member 19 can move relative to the tappet 22, thereby avoiding the necessity to provide the circlip or stop 40. FIG. 7 illustrates a modification to the arrangement of FIG. 6 in which the drive member 17 and piston member 19 are formed integrally with one another. Operation of these embodiments is substantially as described hereinbefore and so will not be described in further detail.

Figure 8:
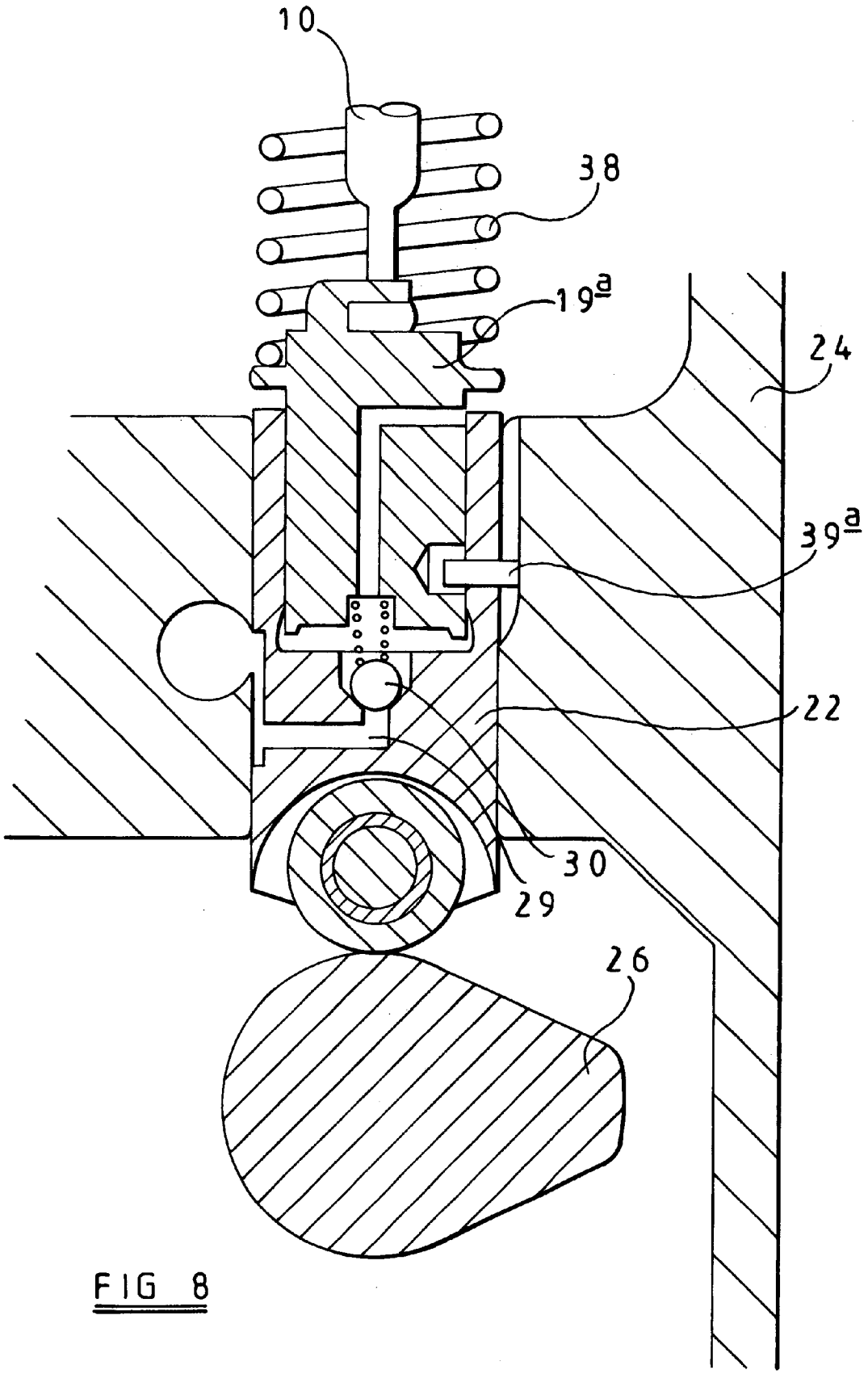

FIG. 8 illustrates an arrangement which operates in a manner similar to that of FIGS. 1 to 3, but in which a peg 39*a* is used to ensure that the tappet 22 cannot move angularly relative to the housing 24, the peg 39*a* extending into a recess formed in the piston member 19 to retain the piston member 19 in position, during assembly, but to allow free movement of the piston member 19 in use. The piston member 19 is of sufficient axial length that the drive member 17 can be omitted, the piston member 19 being secured to the pumping plunger 10. Rather than providing the relief passage 33 within the tappet 22, the relief passage 33 is defined by drillings formed in the piston member 19, the relief passage 33 being closed by the tappet 22 when the piston member 19 occupies a lower position relative to the tappet 32 and opening when the piston member 19 occupies a raised position relative to the tappet 22.

Figure 10:
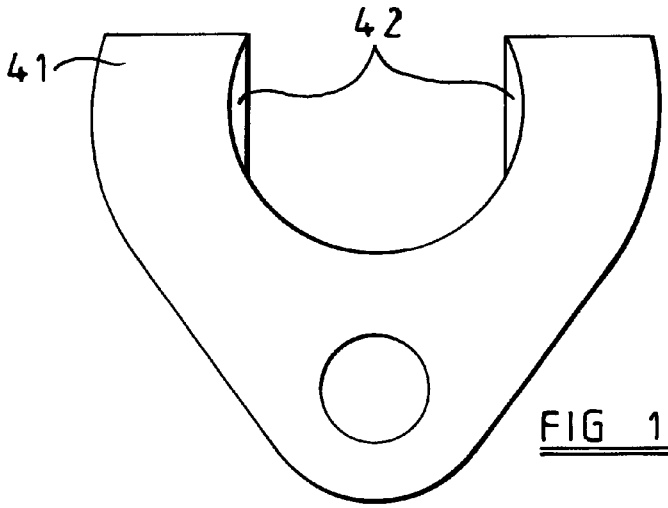
FIGS. 9 and 10 illustrate a further embodiment.
Figure 9:
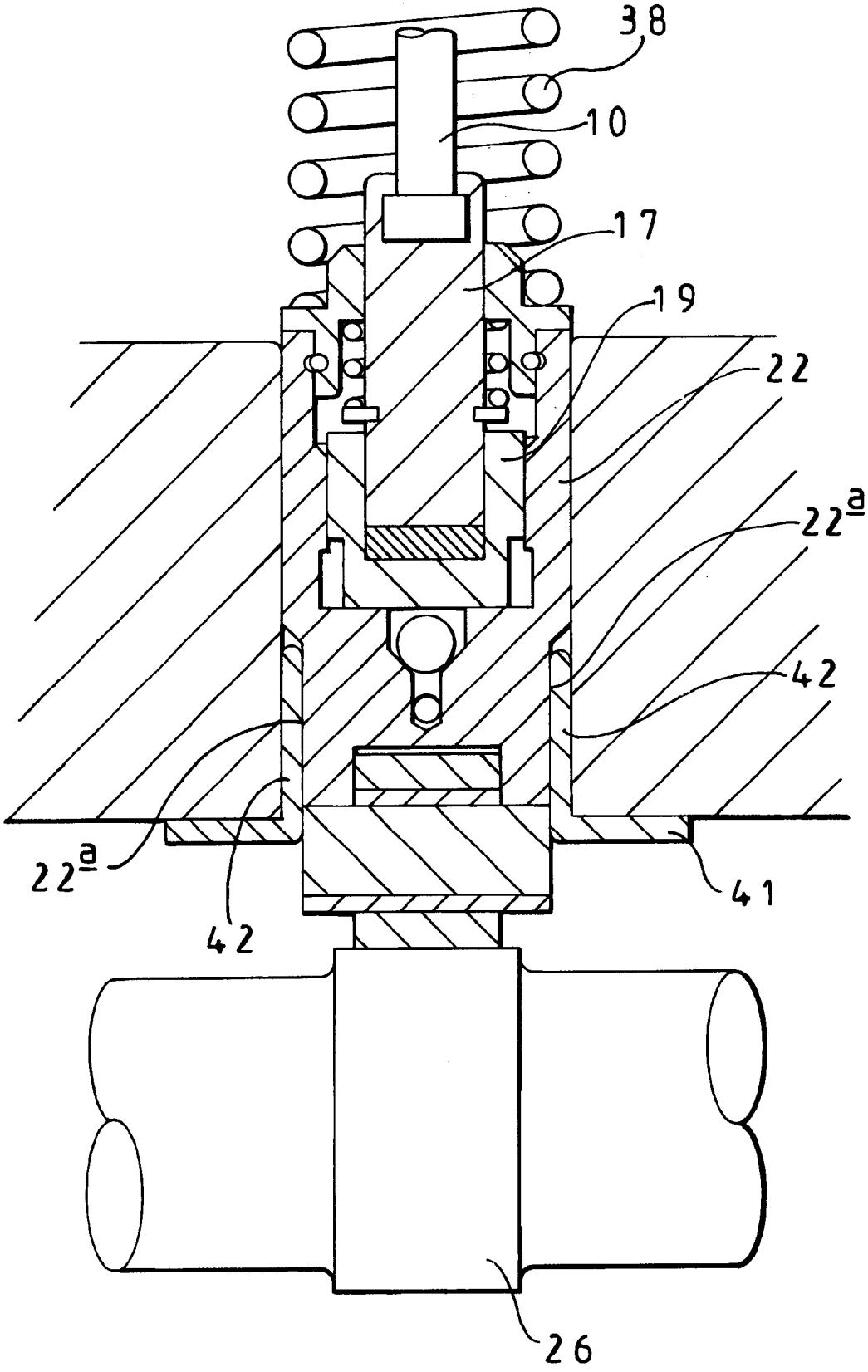

FIGS. 9 and 10 illustrate an alternative technique for securing the tappet 22 against rotation or angular movement relative to the housing 24. In the arrangement illustrated in FIGS. 9 and 10, the tappet 22 is shaped to define a pair of flats 22*a*, and the housing 24 has secured thereto a yolk 41 including a pair of projections 42 which extend into the recesses defined between the flats 22*a* of the tappet 22 and the bore 23. The cooperation between the flats 22*a* and the projections 42 holds the tappet 22 against angular movement relative to the housing 24. One advantage of using this technique for holding the tappet 22 against angular movement is that there is no necessity to provide a tappet location feature at the upper end of the tappet 22 in the orientation illustrated. Where the tappet 22 is located within a bore 23 which is of relatively short axial extent, then the provision of a feature upon the tappet 22 riding within a formation provided in the bore 23 is not always possible. Although this tappet location technique is illustrated for use with the arrangement of FIG. 4, it will be appreciated that it may be used with any of the other embodiments described hereinbefore, and may be used in fuel pumps of other types including those which do not have a cam drive arrangement of controllable axial length.

Figure 11:
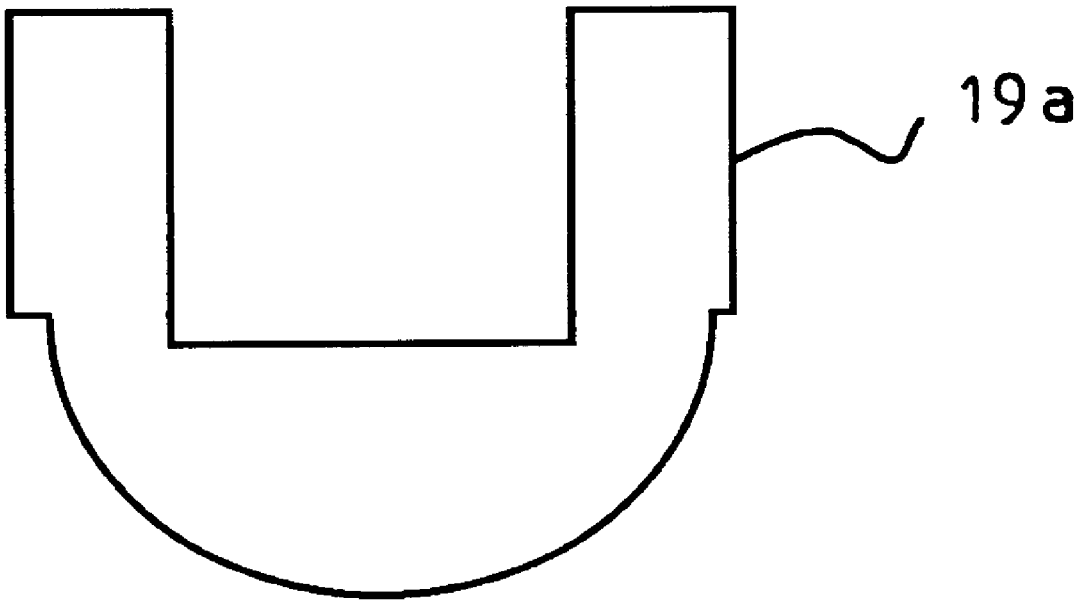
FIG. 11 is a view of a piston member according to another embodiment.

In any of the embodiments described hereinbefore, if there is concern that it may not be possible to exactly align the piston member 19 with the bore formed in the tappet 22, particularly during assembly, then one possible solution may be to form the piston member 19*a* to include a region of part-spherical form, as shown in FIG. 11. The part-spherical region engaging or cooperating with the surface of the bore formed in the tappet in such a manner that the axis of the piston member 19*a* need not be exactly coaxial with that of the tappet, but may be angled slightly thereto.

The invention is particularly suitable for use in controlling the timing of fuel delivery and permitting the timing of such delivery to be advanced when an associated engine is cold. As shown in FIG. 1, in such an arrangement the oil pressure supplied to the supply passage 32 may be controlled using a suitable temperature sensitive valve 50. It will be appreciated, however, that the invention is suitable for use in other arrangements in which the timing of fuel delivery is to be controlled, and is not restricted to arrangements in which the timing of fuel delivery is modified to compensate for the engine operating temperature.

What is claimed is:

1. A fuel pump comprising a pumping plunger reciprocable within a plunger bore under the action of a cam drive arrangement, the cam drive arrangement comprising:

first and second surfaces defining therebetween a chamber, the volume of which can be controlled to control the spacing of the first and second surfaces, thereby permitting control of the axial length of the cam drive arrangement;

wherein the first surface is defined by a tappet member which acts to transmit a force from the cam drive arrangement to the pumping plunger;

wherein the second surface is defined by a piston member slidable within a tappet bore formed in the tappet member;

wherein the tappet member is shaped to define, at least in part, a relief passage which communicates with the chamber upon movement of the piston member beyond a predetermined position.

2. The fuel pump as claimed in claim 1, further comprising a filling port, the filling port being obscured, in use, by the pumping plunger, whereby adjustment of the axial length of the cam drive arrangement permits the timing at which the filling port is obscured by the pumping plunger, and hence the timing of commencement of pressurization of fuel by the pump, to be controlled.

3. The fuel pump as claimed in claim 1, comprising a spring arrangement arranged to apply a biasing force to the piston member which tends to minimize the volume of the chamber.

4. The fuel pump as claimed in claim 1, wherein the plunger bore defines a pumping chamber for fuel, reciprocal movement of the pumping plunger within the plunger bore causing fuel pressurization within the pumping chamber, in use, the fuel pump further comprising a further spring arrangement which is arranged to urge the tappet member in a direction to withdraw the pumping plunger from the plunger bore, thereby tending to maximize the volume of the pumping chamber.

5. The fuel pump as claimed in claim 1, wherein the cam drive arrangement includes a drive member which carries the piston member, a force from the piston member being transmitted to the pumping plunger through the drive member.

6. The fuel pump as claimed in claim 5, wherein the drive member and the piston member are integrally formed.

7. The fuel pump as claimed in claim 1, wherein the piston member is secured directly to the pumping plunger.

8. The fuel pump as claimed in claim 1, wherein the chamber is arranged to receive fluid through a supply passage, fluid pressure within the chamber applying a force to the first and second surfaces which serves to increase the volume of the chamber.

9. The fuel pump as claimed in claim 8, further comprising a temperature sensitive valve arrangement, the pressure of fluid supplied to the chamber being controlled in response to an output from the temperature sensitive valve arrangement.

10. A fuel pump comprising a pumping plunger reciprocable within a plunger bore under the action of a cam drive arrangement the cam drive arrangement comprising:

first and second surfaces defining therebetween a chamber, the volume of which can be controlled to control the spacing of the first and second surfaces, thereby permitting control of the axial length of the cam drive arrangement;

wherein the first surface is defined by a tappet member which acts to transmit a force from the cam drive arrangement to the pumping plunger;

wherein the second surface is defined by a piston member slidable within a tappet bore formed in the tappet member;

wherein the tappet member is provided with a circlip which is engageable with the piston member upon movement of the piston member beyond a predetermined amount.

11. The fuel pump as claimed in claim 10, further comprising a filling port, the filling port being obscured, in use, by the pumping plunger, whereby adjustment of the axial length of the cam drive arrangement permits the timing at which the filling port is obscured by the pumping plunger, and hence the timing of commencement of pressurization of fuel by the pump, to be controlled.

12. The fuel pump as claimed in claim 10, comprising a spring arrangement arranged to apply a biasing force to the piston member which tends to minimize the volume of the chamber.

13. The fuel pump as claimed in claim 10, wherein the plunger bore defines a pumping chamber for fuel, reciprocal movement of the pumping plunger within the plunger bore causing fuel pressurization within the pumping chamber, in use, the fuel pump further comprising a further spring arrangement which is arranged to urge the tappet member in a direction to withdraw the pumping plunger from the plunger bore, thereby tending to maximize the volume of the pumping chamber.

14. The fuel pump as claimed in claim 10, wherein the cam drive arrangement includes a drive member which carries the piston member, a force from the piston member being transmitted to the pumping plunger through the drive member.

15. The fuel pump as claimed in claim 14, wherein the drive member and the piston member are integrally formed.

16. The fuel pump as claimed in claim 10, wherein the piston member is secured directly to the pumping plunger.

17. The fuel pump as claimed in claim 10, wherein the chamber is arranged to receive fluid through a supply passage, fluid pressure within the chamber applying a force to the first and second surfaces which serves to increase the volume of the chamber.

18. The fuel pump as claimed in claim 17, further comprising a temperature sensitive valve arrangement, the pressure of fluid supplied to the chamber being controlled in response to an output from the temperature sensitive valve arrangement.

19. A fuel pump comprising a pumping plunger reciprocable within a plunger bore under the action of a cam drive arrangement, the cam drive arrangement comprising:

first and second surfaces defining therebetween a chamber, the volume of which can be controlled to control the spacing of the first and second surfaces, thereby permitting control of the axial length of the cam drive arrangement;

wherein the first surface is defined by a tappet member which acts to transmit a force form the cam drive arrangement to the pumping plunger:

wherein the second surface is defined by a piston member slidable within a tappet bore formed in the tappet member;

wherein the piston member includes a region of part-spherical form which is cooperable with the tappet bore to permit axial misalignment between the piston member and the tappet member.

20. An arrangement for use in a fuel pump comprising a pumping plunger which is reciprocable within a plunger bore under the action of a drive arrangement and a tappet member which is slidable within a further bore provided in a housing for transmitting a force from the drive arrangement to the pumping plunger, the arrangement comprising a yoke secured to the housing, the yoke having at least one projection extending into the bore provided in the housing, the or each projection cooperating with the tappet member so as to substantially prevent angular movement of the tappet member within the further bore.

21. A fuel pump comprising a pumping plunger reciprocable within a plunger bore under the action of a cam drive arrangement, the cam drive arrangement comprising:

first and second surfaces defining therebetween a chamber, the volume of which can be controlled to control the spacing of the first and second surfaces, thereby permitting control of the axial length of the cam drive arrangement;

wherein the first surface is defined by a tappet member which acts to transmit a force from the cam drive arrangement to the pumping plunger;

wherein the tappet member is slidable within a further bore provided in a housing, the fuel pump further comprising an arrangement for substantially preventing angular movement of the tappet member within the further bore;

wherein the arrangement comprises a peg, wherein the tappet member is provided with the peg which extends through an opening provided in the drive member forming part of the drive arrangement so as to substantially prevent angular movement of the tappet member within the further bore.

22. A fuel pump comprising a pumping plunger reciprocable within a plunger bore under the action of a cam drive arrangement, the cam drive arrangement comprising:

first and second surfaces defining therebetween a chamber, the volume of which can be controlled to control the spacing of the first and second surfaces, thereby permitting control of the axial length of the cam drive arrangement;

wherein the first surface is defined by a tappet member which acts to transmit a force from the cam drive arrangement to the pumping plunger;

wherein the tappet member is slidable within a further bore provided in a housing, the fuel pump further comprising an arrangement for substantially preventing angular movement of the tappet member within the further bore;

wherein the arrangement comprises a yoke secured to the housing, the yoke having at least one projection extending into the further bore provided in the housing, the or each projection cooperating with the tappet member so as to substantially prevent angular movement of the tappet member within the further bore.

* * * * *